United States Patent [19]

Schumacher et al.

[11] Patent Number: 4,494,988

[45] Date of Patent: Jan. 22, 1985

[54] GALLING AND WEAR RESISTANT STEEL ALLOY

[75] Inventors: William J. Schumacher, Monroe, Ohio; Harry Tanczyn, Baltimore, Md.

[73] Assignee: Armco Inc., Middletown, Ohio

[21] Appl. No.: 562,984

[22] Filed: Dec. 19, 1983

[51] Int. Cl.[3] ..... C22C 39/26

[52] U.S. Cl. ..... 75/128 A; 75/128 C; 75/125; 75/124; 75/246; 148/38

[58] Field of Search ..... 75/128 A, 128 C, 246, 75/125, 124 F; 148/38, 12 E

[56] References Cited

U.S. PATENT DOCUMENTS 1,561,306 11/1925 Brace ..... 75/128 A 3,912,503 10/1975 Schumacher et al. ..... 75/128 A

*Primary Examiner*—M. J. Andrews

*Assistant Examiner*—Debbie Yee

*Attorney, Agent, or Firm*—Frost & Jacobs

[57] ABSTRACT

A chromium-nickel-silicon-manganese steel alloy consisting essentially of about 1.0% maximum carbon, from 10% to about 16% manganese, about 0.07% maximum phosphorus, about 0.1% maximum sulfur, 4% to 6% silicon, 4% to 6% chromium, 4% to about 6% nickel, about 0.05% maximum nitrogen, and balance essentially iron. Preferred embodiments exhibit excellent galling resistance, metal-to-metal wear resistance, high impact strength, oxidation resistance and corrosion resistance.

13 Claims, No Drawings

GALLING AND WEAR RESISTANT STEEL ALLOY

BACKGROUND OF THE INVENTION

This invention relates to a chromium-nickel-silicon-manganese bearing steel alloy and products fabricated therefrom which exhibit wear resistance and cryogenic impact strength superior to, and corrosion resistance and oxidation resistance at least equivalent to, austenitic nickel cast irons. In a preferred embodiment the alloy and cast, wrought and sintered products thereof, which are substantially fully austenitic, are superior in galling resistance to austenitic nickel cast irons and to a stainless steel disclosed in U.S. Pat. No. 3,912,503 and developed by the present inventors which was hitherto considered to have outstanding galling resistance, despite the fact that the level of expensive alloying ingredients and melting cost are much lower in the steel of this invention.

International Nickel Company has sold a series of austenitic nickel cast irons for many years under the trademarks "NI-Resists" and "Ductile NI-Resists". A number of grades is available as described in "Engineering Properties and Applications of the NI-Resists and Ductile NI-Resists", published by International Nickel Co., which are covered by ASTM Specifications A437, A439 and A571. The overall ranges for "NI-Resist" alloys are up to 3.00% total carbon, 0.50% to 1.60% manganese, 1.00% to 5.00% silicon, up to 6.00% chromium, 13.5% to 36.00% nickel, up to 7.50% copper, 0.12% maximum sulfur, 0.30% maximum phosphorus, and balance iron. The "Ductile NI-Resists" are similar in composition but are treated with magnesium to convert the graphite to spheroidal form.

U.S. Pat. No. 2,165,035 discloses a steel containing from 0.2% to 0.75% carbon, 6% to 10% manganese, 3.5% to 6.5% silicon, 1.5% to 4.5% chromium, and balance iron.

U.S. Pat. No. 4,172,716 discloses a steel containing 0.2% maximum carbon, 10% maximum manganese, 6% maximum silicon, 15% to 35% chromium, 3.5% to 35% nickel, 0.5% maximum nitrogen, and balance iron.

U.S. Pat. No. 4,279,648 discloses a steel containing 0.03% maximum carbon, 10% maximum manganese, 5% to 7% silicon, 7% to 16% chromium, 10% to 19% nickel, and balance iron.

U.S. Pat. No. 3,912,503 issued to the present inventors, discloses a steel (sold under the trademark NITRONIC 60) containing from 0.001% to 0.25% carbon, 6% to 16% manganese, 2% to 7% silicon, 10% to 25% chromium, 3% to 15% nickel, 0.001% to 0.4% nitrogen, and balance iron. This steel has excellent galling resistance.

Other publications disclosing chromium-nickel-silicon bearing steels, and including varying levels of carbon and manganese, include U.S. Pat. Nos. 2,747,989; 3,839,100; 3,674,468; British Pat. No. 1,275,007 and Japanese No. J57185-958.

AISI Type 440C is a straight chromium stainless steel (about 16% to 18% chromium) considered to have excellent wear and galling resistance.

The manufacturer of "NI-Resists" alloys alleges that they are satisfactory in applications requiring corrosion resistance, wear resistance, erosion resistance, toughness and low temperature stability. Wear resistance is intended to refer to metal-to-metal rubbing parts, while erosion resistance is referred to in connection with slurries, wet steam and gases with entrained particles.

Although galling and wear may occur under similar conditions, the types of deterioration involved are not similar. Galling may best be defined as the development of a condition on a rubbing surface of one or both contacting metal parts wherein excessive friction between minute high spots on the surfaces results in localized welding of the metals at these spots. With continued surface movement, this results in the formation of even more weld junctions which eventually sever in one of the base metal surfaces. The result is a build-up of metal on one surface, usually at the end of a deep surface groove. Galling is thus associated primarily with moving metal-to-metal contact and results in sudden catastrophic failure by seizure of the metal parts.

On the other hand, wear can result from metal-to-metal contact or metal-to-non-metal contact, e.g., the abrasion of steel fabricated products by contact with hard particles, rocks or mineral deposits. Such wear is characterized by relatively uniform loss of metal from the surface after many repeated cycles, as contrasted to galling which usually is a more catastrophic failure occurring early in the expected life of the product.

SUMMARY OF THE INVENTION

It is an object of the present invention to provide a steel alloy in cast, wrought or powder metallurgy forms having wear resistance and strength superior to austenitic nickel cast irons, which contains a relatively low level of expensive alloying ingredients.

It is a further object of the invention to provide an alloy which is substantially fully austenitic and which is far superior in galling resistance to austenitic nickel cast iorn and which further exhibits corrosion resistance and oxidation resistance at least equivalent to austenitic nickel cast iron.

The steel of the present invention is not classified as a stainless steel since the chromium content ranges from about 4% to about 6%. However, the required presence of silicon also in the range of 4% to about 6% in combination with chromium confers corrosion and oxidation resistance comparable to that of some stainless steels.

According to the present invention, there is provided a steel alloy having high tensile strength, metal-to-metal wear resistance, and oxidation resistance, the alloy consisting essentially of, in weight percent, about 1.0% maximum carbon, from 10% to about 16% manganese, about 0.07% maximum phosphorus, about 0.1% maximum sulfur, 4% to about 6% silicon, 4% to about 6% chromium, 4% to about 6% nickel, about 0.05% maximum nitrogen, and balance essentially iron.

In a preferred embodiment which exhibits superior galling resistance, good impact strength and good corrosion resistance, and which is substantially fully austenitic in the hot worked condition, the steel alloy consists essentially of 0.05% maximum carbon, from 11% to about 14% manganese, about 0.07% maximum phosphorus, about 0.1% maximum sulfur, 4% to about 6% silicon, 4% to about 6% chromium, 4.5% to about 6% nickel, about 0.05% maximum nitrogen, and balance essentially iron.

The elements manganese, silicon, chromium and nickel, and the balance therebetween, are critical in every sense. In the improved embodiment having superior galling resistance, good impact strength and good corrosion resistance, the carbon and manganese ranges are critical. Omission of one of the elements, or departure of any of these critical elements from the ranges set forth above results in loss in one or more of the desired properties.

DETAILED DESCRIPTION

A more preferred composition exhibiting optimum galling resistance together with high tensile strength, metal-to-metal wear resistance, impact resistance, corrosion and oxidation resistance, consists essentially of, in weight percent, 0.04% maximum carbon, from 12% to about 13.5% manganese, about 4.5% to 5.2% silicon, about 4.7% to about 5.3% chromium, about 5% to about 5.5% nickel, 0.05% maximum nitrogen, and balance essentially iron.

For superior metal-to-metal wear resistance a preferred composition consists essentially of, in weight percent, about 0.9% maximum carbon, 10% to about 13% manganese, about 4.5% to about 5.5% silicon, about 5% to about 6% chromium, about 4.5% to about 5.5% nickel, about 0.05% maximum nitrogen, and balance essentially iron. In this embodiment, carbon preferably is present in the amount of at least 0.1%.

Manganese is essential within the broad range of 10% to about 16%, preferably 11% to about 14%, and more preferably 12% to about 13.5%, for optimum galling resistance, with carbon restricted to a preferred maximum of 0.05% and more preferably 0.04%. In the steel of the present invention, it has been found that manganese tends to retard the rate of work hardening, improves ductility after cold reduction if present in an amount about 11% and improves cryogenic impact properties. As is well known, manganese is an austenite stabilizer, and at least 10% is essential for this purpose. For galling resistance, at least 11% manganese should be present. However, for good metal-to-metal wear resistance, manganese can be present at about the 10% level if relatively high carbon is present. Since manganese tends to react with and erode silica refractories used in steel melting processes, a maximum of about 16% should be observed.

Silicon is essential within the range of 4% to about 6% in order to control corrosion and oxidation resistance. It has a strong influence on multi-cycle sliding (crossed cylinder) wear. A maximum of about 6% silicon should be observed since amounts in excess of this level tend to produce cracking in a cast ingot during cooling.

Chromium is essential within the range of 4% to about 6% for corrosion and oxidation resistance. In combination with manganese, it helps to hold nitrogen in solution. Since chromium is a ferrite former, a maximum of about 6% should be observed in order to maintain a substantially fully austenitic structure in the steel of the invention. Preferably a maximum of about 5.3% chromium is observed for this purpose where optimum galling resistance is desired.

Nickel is essential within a range of 4% to about 6% in order to help assure a substantially fully austenitic structure and to prevent transformation to martensite. Corrosion resistance is improved by the presence of nickel within this range. More than about 6% nickel adversely affects galling resistance.

Carbon is of course present as a normally occurring impurity, and can be present in an amount up to about 1.0% maximum. Excellent wear resistance can be obtained with carbon up to this level or preferably about 0.9% maximum. However, carbon in an amount greater than 0.05% adversely affects galling resistance, and a more preferred maximum of 0.04% should be observed for optimum galling resistance. Corrosion resistance is also improved if a maximum of 0.05% carbon is observed. A broad maximum of about 1.0% carbon must be observed for good hot workability and good machinability.

Nitrogen is normally present as an impurity and may be tolerated in amounts up to about 0.05% maximum. It is a strong austenite former and hence is preferably retained in an amount which helps to insure a substantially fully austenitic structure, at least in the hot rolled condition. Nitrogen also improves the tensile strength and galling resistance of the steel of the invention. However, a maximum of 0.05% should be observed since amounts in excess of this level cannot be held in solution with the relatively low chromium levels of the steel, despite the relatively high manganese levels.

Phosphorus and sulfur are normally occurring impurities, and can be tolerated in amounts up to about 0.07% for phosphorus, and up to about 0.1% for sulfur. Machinability is improved by permitting sulfur up to about 0.1% maximum.

It is within the scope of the invention to substitute up to 3% molybdenum or aluminum in place of chromium on a 1:1 basis for additional corrosion and/or oxidation resistance. Up to 4% copper may be substituted for nickel on a 2:1 basis (i.e., two parts of copper for one part of nickel) for greater economy in melting material cost. Any such substitutions should not change the substantially fully austenitic structure, which is maintained by balancing of the essential elements.

Any one or more of the preferred or more preferred ranges indicated above can be used with any one or more of the broad ranges for the remaining elements set forth above.

The steel of the invention may be melted and cast in conventional mill equipment. It may then be hot worked or wrought into a variety of product forms, and cold worked to provide products of high strength. Hot rolling of the steel has been conducted using normal steel process practices and it was found that good hot workability occurred. If the steel is intended for use in cast form, the elements should be balanced in such manner that the as-cast material will contain less than about 1% ferrite, if excellent galling resistance is required.

As pointed out above, galling resistance and wear resistance are not similar. Good wear resistance does not insure good galling resistance. Excellent wear resistance can be obtained relatively easily in steel alloys of rather widely varying compositions. It is much more difficult to develop an alloy with excellent galling resistance, and this important property is achieved in the present steel by reason of the preferred manganese range of 11% to about 14% and by observing a maximum of 0.05% carbon. The minimum manganese content is thus highly critical in the present steel in maintaining the proper compositional balance for best galling resistance.

A number of experimental heats of steels of the invention has been prepared and compared to prior art alloys and steels similar to the present invention but departing from the ranges thereof in one or more of the critical elements. Compositions are set forth in Table I.

Galling resistance of steels of the invention in comparison to other steels, including the steel of the abovementioned U.S. Pat. No. 3,912,503, is summarized in Table II.

The test method utilized in obtaining the data of Table II involved rotation of a polished cylindrical section or button for one revolution under pressure against a polished block surface in a standard Brinnell hardness machine. Both the button and block specimens were degreased by wetting with acetone, or other degreasing agent and the hardness ball was lubricated just prior to testing. The button was hand-rotated slowly at a predetermined load for one revolution and examined for galling at 10 magnification. If galling was not observed, a new button and block area couple was tested at successively higher loads until galling was first observed. In Table II the button specimen is the first alloy mentioned in each couple and the second alloy is the block specimen.

The test data of Table II demonstrate the critically of a minimum manganese content of 11.0% and a maximum carbon level of 0.05%, for optimum galling resistance. The tests run against Type 430(HRB 91) show that only Sample 4 containing 11.9% manganese and 0.02% carbon performed well. Sample 3 containing 10.7% manganese and 0.024% carbon exhibited a sharp decrease in galling resistance as compared to Sample 4.

Against Type 316(HRB 98) Sample 4 again showed marked superiority, while Sample 3 containing 10.7% manganese was substantially superior to Sample 2 containing 9.9% manganese.

Tests against soft martensitic steels Type 410 and 17-4 PH (NACE approved double H 1150 condition) further demonstrated the superiority of Sample 4.

In the as cast condition against Type 316 Sample 5, containing 10.2% manganese and 0.11% carbon, was satisfactory in comparison to Samples 6, 7 and 8, all of which had relatively high carbon. In the annealed condition Sample 4 again exhibited excellent results both against Type 316 and Type 17-4 PH (single H 1150 condition).

Table III summarizes metal-to-metal wear resistance tests. These were conducted in a Taber Met-Abrader, 0.5 inch crossed cylinders, 16 pound load, 10,000 cycles, dry, in air, duplicates, degreased, at room temperature and corrected for density differences.

It is clear from the self-mated couples of Table III that the steels of the invention were far superior to Ni-Resist alloys and superior to Nitronic 60, at least at 105 RPM. A manganese level above 10% improved wear resistance at 105 RPM but impaired it slightly at 415 RPM.

When mated against 17-4 PH the results were similar for tests conducted at 105 RPM, with samples 4 and 5 showing far better results than Ni-Resist. These samples also outperformed Nitronic 60 and even Stellite 6B, a cobalt base wear alloy.

The extremely high wear rate for the Ni-Resist alloys at 415 RPM apparently resulted from failure of these alloys to form a protective glaze oxide film at this high speed of rotation. It is evident that the steel of the invention thus exhibits excellent metal-to-metal wear resistance at a manganese level of 10% or higher and a carbon level of at least about 0.5%. With carbon at this level manganese may be close to the minimum of 10.0% where metal-to-metal wear resistance is the property of primary interest.

Table IV reports impact strengths of hot rolled and annealed specimens in comparison to Ni-Resist Type D2. Sample 3, containing 10.7% manganese and 0.024% carbon, exhibited both room temperature and cryogenic impact strengths far above those of the Ni-Resist alloy. Moreover, Type D2 is considered to have higher impact strength than the regular Ni-Resist alloys.

Mechanical properties in the cold reduced condition are summarized in Table V. Samples were hot rolled to 0.1 inch, annealed at 1950° F. and cold reduced 20%, 40% and 60%. The steels of the invention exhibited a high work hardening capacity, and it is evident that increased manganese levels tend to retard the work hardening rate.

In Table VI the effect of heat treatment on ferrite/martensite stability and hardness is summarized. One series of samples was tested in the hot rolled condition and subjected to heat treatment for one hour at a variety of temperatures. As-cast samples were also tested. It is significant that steels of the invention were substantially fully austenitic and stabilized at all carbon levels with all heat treatments as shown by the low ferrite contents. As carbon increased the austenite was strengthened as shown by the hardness values of heats at 0.52% and 0.92% carbon, respectively. At manganese levels less than 10% and low carbon as exemplified by Samples 1 and 2, a fully austenitic structure could not be maintained at 1600° F. and above, and some transformation to martensite occurred as shown by the ferrite numbers and hardness changes.

Oxidation and corrosion tests have been conducted and are reported in Table VII. The results are averages of duplicate samples. It is evident that the steels of the invention were far superior to NI-Resist Types 1 and 2 in oxidation resistance and significantly superior in sea water corrosion resistance. The oxide depth of the steel of the invention represented virtual absence of scale in the oxidation test. In the corrosion tests the NI-Resist samples became darkened over their entire surfaces, while the steel of the invention remained shiny except for a few small areas.

The test data herein are believed to establish clearly that the steel of the present invention achieves the objectives of superior galling resistance, excellent wear resistance, high room temperature and cryogenic impact strengths, and in cast, wrought or cold worked forms.

TABLE I

| | Compositions - Weight Percent | | | | | | | |
|---|---|---|---|---|---|---|---|---|
| Sample No. | C | Mn | Si | Cr | Ni | Cu | N | Mo |
| 1 | .024 | 9.1 | 5.3 | 5.3 | 4.9 | .3 | .02 | .2 |
| 2 | .024 | 9.9 | 5.2 | 5.3 | 4.9 | .3 | .02 | .2 |
| 3* | .024 | 10.7 | 5.2 | 5.3 | 4.9 | .3 | .02 | .2 |
| 4* | .02 | 11.9 | 5.2 | 5.0 | 5.0 | — | .02 | — |
| 5* | .11 | 10.2 | 5.0 | 5.7 | 5.3 | — | .03 | .08 |
| 6* | .52 | 10.0 | 4.9 | 5.6 | 5.2 | — | .03 | .07 |
| 7* | .92 | 10.0 | 4.9 | 5.6 | 5.1 | — | .03 | .07 |
| 8 | .49 | 7.8 | 5.2 | 4.9 | 5.0 | — | .02 | <.01 |
| NI-Resist Type 1 | 2.8 | 1.25 | 1.8 | 2.6 | 15.5 | 6.5 | | — |
| NI-Resist Type 2 | 2.8 | 1.00 | 1.8 | 2.6 | 20.0 | 0.5 | | — |
| NITRONIC 60 (USP3912503) | .09 | 8 | 4 | 16 | 7.0 | .04 | .14 | .02 |
| STELLITE 6 | 1.02 | 1.2 | — | 30 | — | — | — | — 4.5 W, 63 Co |

*Steels of the invention

TABLE II

Galling Resistance
Button and Block Galling Test - 1 Revolution

| Couple | | Contact Stress (ksi) | Comment |
|---|---|---|---|
| Sample 1 | vs. AISI 430 | 9.6 | severe galling |
| Sample 2 | vs. AISI 430 | 22.8 | severe galling |
| Sample 3* | vs. AISI 430 | 31.5 | severe galling |
| Sample 4* | vs. AISI 430 | 44.0 | threshold stress |
| NITRONIC 60 | vs. AISI 430 | 36.0 | threshold stress |
| Sample 2 | vs. AISI 316 | 6.8 | severe galling |
| Sample 2 | vs. AISI 316 | 7.9 | OK |
| Sample 3* | vs. AISI 316 | 14.1 | OK |
| Sample 3* | vs. AISI 316 | 19.1 | slight scoring |
| Sample 3* | vs. AISI 316 | 25.5 | OK |
| Sample 3* | vs. AISI 316 | 29.8 | slight scoring |
| Sample 4* | vs. AISI 316 | 50.4 | OK |
| Sample 2 | vs. 17-4PH | 6.4 | severe galling |
| Sample 3* | vs. 17-4PH | 7.9 | severe galling |
| Sample 3* | vs. AISI 410 | 7.3 | slight galling |
| Sample 3* | vs. 17-4PH | 7.0 | OK |
| Sample 4* | vs. 17-4PH | 54.3 | OK |
| As Cast | | | |
| Sample 5* | vs. AISI 316 | 43+ | threshold stress |
| Sample 6* | vs. AISI 316 | 29 | threshold stress |
| Sample 7* | vs. AISI 316 | 26 | threshold stress |
| Sample 8 | vs. AISI 316 | 7 | threshold stress |
| Annealed 1950° F. - ½ hour - W.Q. | | | |
| Sample 4* | vs. AISI 316 | 50+ | OK |
| Sample 5* | vs. AISI 316 | 42+ | OK |
| Sample 6* | vs. AISI 316 | 29.8 | galling |
| Sample 7* | vs. AISI 316 | 27.2 | galling |
| Sample 8 | vs. AISI 316 | 10 | threshold stress |
| Sample 5* | vs. AISI 410 | 46+ | OK |
| Sample 6* | vs. AISI 410 | 48+ | OK |
| Sample 7* | vs. AISI 410 | 45 | threshold stress |
| Sample 8 | vs. AISI 410 | 16 | threshold stress |
| Sample 4* | vs. 17-4PH | 54.3 | OK |
| Sample 5* | vs. 17-4PH | 8.5 | galling |
| Sample 8 | vs. 17-4PH | 7.9 | severe galling |

*Steels of the invention

TABLE III

Metal-To-Metal Wear Resistance
Specimens Hot Rolled and Annealed at 1950° F.
½ or 1 hour - W.Q.

| Couple | Wear (mg/1000 cycles) RPM: 105 | 415 |
|---|---|---|
| Self-Mated | | |
| Sample 1 | 2.86 | 1.20 |
| Sample 2 | 1.72 | 1.56 |
| Sample 3* | 1.00 | 1.89 |
| Sample 4* | 0.90 | — |
| Sample 5* | 1.46 | 0.97 |
| Sample 6* | 1.31 | 0.35 |
| Sample 8 | 1.17 | 0.37 |
| Ni-Resist Type 1 | 4.45 | 508.52 |
| Ni-Resist Type 2 | 8.80 | 522.32 |
| Nitronic 60 | 2.79 | 1.58 |
| Stellite 6B (cobalt wear alloy) | 1.00 | 1.27 |
| Mated to 17-4 PH | | |

TABLE III-continued

Metal-To-Metal Wear Resistance
Specimens Hot Rolled and Annealed at 1950° F.
½ or 1 hour - W.Q.

| Couple | Wear (mg/1000 cycles) RPM: 105 | 415 |
|---|---|---|
| Sample 1 | 5.28 | — |
| Sample 2 | 3.12 | — |
| Sample 3* | 2.15 | — |
| Sample 4* | 1.87 | — |
| Sample 5* | 1.87 | — |
| Sample 6* | 4.48 | — |
| Sample 8 | 3.15 | |
| Ni-Resist Type 1 | 10.87 | |
| Ni-Resist Type 2 | 31.81 | |
| Nitronic 60 | 5.40 | |
| Stellite 6B (cobalt wear alloy) | 3.80 | |

*Steels of the invention

TABLE IV

Impact Strength
Specimens Hot Rolled & Annealed at
1950° F. 1 hour - W.Q.

| Sample | Test Temp. (°F.) | CVN (ft-lbs) | Lateral Expansion (mils) |
|---|---|---|---|
| 1 | R.T. | 65.0 | 40.0 |
| | −100 | 41–40.5 | 19.5–20.0 |
| | −320 | 11.0 | 55.0 |
| 2 | R.T. | 77.0 | 48.0 |
| | −100 | 54.0− | 25.5 |
| | −320 | 12.5–14.5 | 7.5–8.5 |
| 3* | R.T. | 99.5 | 63.0 |
| | −100 | 76.0–79.5 | 32.5–42.0 |
| | −320 | 16.0 | 7.0 |
| Ni-Resist D2 | R.T. | 12.5 | |
| | −100 | 10.0 | |
| | −320 | 4.5 | |

*Steel of the invention

TABLE V

Mechanical Properties
Cold Rolled from 0.1"

| Sample | % C.R. | UTS (ksi) | .2% (ksi) | % El. | HRC |
|---|---|---|---|---|---|
| 1 | 20 | 194 | 134 | 14 | 42 |
| | 40 | 232 | 210 | 5 | 46 |
| | 60 | 263 | 247 | 4 | 49 |
| 2 | 20 | 189 | 132 | 18 | 41 |
| | 40 | 216 | 186 | 10 | 46 |
| | 60 | 260 | 233 | 4 | 49 |
| 3* | 20 | 175 | 108 | 23 | 37 |
| | 40 | 207 | 174 | 14 | 45 |
| | 60 | 246 | 225 | 4 | 48 |
| 4* | (H.R. & annealed) | 131 | 30 | 50 | — |
| Ni-Resist D2 (as cast) | | 60 | 32 | 14 | B86 |

*Steels of the invention

TABLE VI

Effect of Heat Treatment on Stability

| Sample | | 1000° F. | 1200° F. | 1400° F. | 1600° F. | 1800° F. | 2000° F. |
|---|---|---|---|---|---|---|---|
| | As H.R. | Hot Rolled - 1 Hour @ Temp. | | | | | |
| 1 FN** | .7–1.1 | .8–1.0 | .8–1.2 | 1.0–1.3 | 1.0–1.6 | 4–4.5 | 6.8–8.0 |
| HR | B96 | B98 | B98 | B98 | B98 | B98 | B97 |
| 2 FN** | .4–.6 | .4–.5 | .4–.6 | .4–.7 | .4–.6 | 1.3–1.6 | 2.0–2.5 |
| HR | B95 | B97 | B98 | B98 | B97 | B95 | B96 |
| 3* FN** | .2–.3 | .3–.6 | .2–.3 | .2–.3 | <.2 | .3–.5 | .4–.8 |
| HR | B96 | B99 | B99 | B97 | B97 | B95 | B93 |
| | As Cast | As-Cast - ½ Hour @ Temp.* | | | | | |
| FN** | .5–3.0 | .1 | .2 | .2 | .2 | .5 | .7 |
| HR | — | B93 | B92 | B90 | B90 | B91 | B89 |
| 6* FN** | .4–.6 | .2 | .6 | 1.0 | .5 | .2 | .2 |

TABLE VI-continued

| Sample | | Effect of Heat Treatment on Stability | | | | | |
|---|---|---|---|---|---|---|---|
| | | 1000° F. | 1200° F. | 1400° F. | 1600° F. | 1800° F. | 2000° F. |
| HR | — | C20 | C32 | C30 | C26 | C30 | B98 |
| 7* FN** | .6–.9 | .2 | .7 | .5 | .2 | .2 | .2 |
| HR | — | C33 | C25 | C31 | C32 | C32 | C28 |

*Steels of the invention
**Ferrite Number - % ferrite as measured by the ferrite scope

TABLE VII

| Oxidation and Corrosion Resistance | |
|---|---|
| Oxidation<br>1600° F. for 8 days in air - duplicate specimens | |
| Sample | Oxide Depth (mils) |
| 3* | 0.5 |
| NI-Resist Type 1 | 25 |
| NI-Resist Type 2 | 23 |
| Sea Water Corrosion<br>5–48 hour periods @ 50° C. - duplicate specimens | |
| Sample | Corrosion Rate (mils/yr) |
| 4* | 1.7 |
| NI-Resist Type 1 | 4.8 |
| NI-Resist Type 2 | 4.8 |

*Steels of the invention

We claim:

1. A steel alloy having high tensile strength, metal-to-metal wear resistance, and oxidation resistance, said alloy consisting essentially of, in weight percent, about 1.0% maximum carbon, from 10% to about 16% manganese, about 0.07% maximum phosphorus, about 0.1% maximum sulfur, 4% to about 6% silicon, 4% to about 6% chromium, 4% to about 6% nickel, about 0.05% maximum nitrogen, and balance essentially iron.

2. The alloy claimed in claim 1 having superior galling resistance, good corrosion resistance and cryogenic impact strength, and being substantially fully austenitic in the hot worked condition, consisting essentially of 0.05% maximum carbon, from 11% to about 14% manganese, 4% to about 6% silicon, 4% to about 6% chromium, 4.5% to about 6% nickel, about 0.05% maximum nitrogen, and balance essentially iron.

3. The alloy claimed in claim 2, consisting essentially of 0.04% maximum carbon, from 12% to about 13.5% manganese, about 4.5% to about 5.2% silicon, about 4.7% to about 5.3% chromium, about 5% to about 5.5% nickel, 0.05% maximum nitrogen, and balance essentially iron.

4. The alloy claimed in claim 1 having superior metal-to-metal wear resistance, consisting essentially of about 0.9% maximum carbon, 10% to about 13% manganese, about 4.5% to about 5.5 silicon, about 5% to about 6% chromium, about 4.5% to about 5.5% nickel, about 0.05% maximum nitrogen, and balance essentially iron.

5. The alloy claimed in claim 4, wherein carbon is at least 0.1%.

6. The alloy claimed in claim 1, wherein up to 3% molybdenum is substituted for chromium on a 1:1 basis.

7. The alloy claimed in claim 1, wherein up to 3% aluminum is substituted for chromium on a 1:1 basis.

8. The alloy claimed in claim 1, wherein up to 4% copper is substituted for nickel on a 2:1 basis.

9. A cast steel alloy having high tensile strength, metal-to-metal wear resistance, and oxidation resistance, said alloy consisting essentially of, in weight percent, about 1.0% maximum carbon, from 10% to about 16% manganese, about 0.07% maximum phosphorus, about 0.1% maximum sulfur, 4% to about 6% silicon, 4% to about 6% chromium, 4% to about 6% nickel, about 0.05% maximum nitrogen, and balance essentially iron.

10. A hot worked product having superior galling resistance, metal-to-metal wear resistance, and good impact resistance and corrosion resistance, said product being fabricated from a steel alloy consisting essentially of, in weight percent, 0.05% maximum carbon, from 11% to about 14% manganese, 4% to about 6% silicon, 4% to about 6% chromium, 4.5% to about 6% nickel, about 0.05% maximum nitrogen, and balance essentially iron.

11. The product claimed in claim 10, wherein said alloy consists essentially of 0.04% maximum carbon, from 12% to about 13.5% manganese, about 4.5% to about 5.2% silicon, about 4.7% to about 5.3% chromium, about 5% to about 5.5% nickel, 0.05% maximum nitrogen, and balance essentially iron.

12. A sintered powder steel alloy having high tensile strength, metal-to-metal wear resistance, and oxidation resistance, said alloy consisting essentially of, in weight percent, about 1.0% maximum carbon, from 10% to about 16% manganese, about 0.07% maximum phosphorus, about 0.1% maximum sulfur, 4% to about 6% silicon, 4% to about 6% chromium, 4% to about 6% nickel, about 0.05% maximum nitrogen, and balance essentially iron.

13. A cold worked product having superior galling resistance, metal-to-metal wear resistance, and good impact resistance and corrosion resistance, said product being fabricated from a steel alloy consisting essentially of, in weight percent, 0.05% maximum carbon, from 11% to about 14% manganese, 4% to about 6% silicon, 4% to about 6% chromium, 4.5% to about 6% nickel, about 0.05% maximum nitrogen, and balance essentially iron.

* * * * *